US006041438A

United States Patent [19]

Kirkwood

[11] Patent Number: 6,041,438

[45] Date of Patent: Mar. 28, 2000

[54] GLOVE WITH INTERDIGITAL AND FINGERTIP REINFORCEMENTS

[76] Inventor: Constance P. Kirkwood, 138 Linwell Road Unit #309, St. Catharines, Ontario, Canada, L2N 6N9

[21] Appl. No.: 09/164,649

[22] Filed: Oct. 1, 1998

[51] Int. Cl.[7] ..... A41D 19/00

[52] U.S. Cl. ..... 2/161.1; 2/161.5; 2/161.6

[58] Field of Search ..... 2/159, 160, 161.1, 2/161.3, 161.5, 161.6, 161.7, 161.8

[56] References Cited

U.S. PATENT DOCUMENTS

| | | | |
|---|---|---|---|
| 1,584,304 | 5/1926 | Kennedy | 2/16 |
| 3,643,386 | 2/1972 | Grzyll | 2/161 |
| 4,071,913 | 2/1978 | Rector | 2/20 |
| 4,594,736 | 6/1986 | Connelly | 2/163 |
| 5,442,816 | 8/1995 | Seketa | 2/161.7 |
| 5,467,484 | 11/1995 | Drescher et al. | 2/161.6 |
| 5,727,257 | 3/1998 | Chen | 2/161.1 |
| 5,774,895 | 7/1998 | Baldwin | 2/161.1 |
| 5,815,840 | 10/1998 | Hamlin | 2/161.6 |

FOREIGN PATENT DOCUMENTS

| | | | |
|---|---|---|---|
| 2241869 | 9/1991 | United Kingdom | 2/160 |

*Primary Examiner*—Diana Oleksa
*Assistant Examiner*—Katherine Moran

[57] ABSTRACT

A gambling glove for protecting the hand of a gambler, particularly when playing a slot machine includes light-weight material for enclosing the hand and a plurality of reinforcement patches positioned to prevent wear in areas particularly contacted while using a slot type gambling machine.

13 Claims, 2 Drawing Sheets

GLOVE WITH INTERDIGITAL AND FINGERTIP REINFORCEMENTS

BACKGROUND OF THE INVENTION

1. Field of the Invention

The present invention relates to gloves and more particularly pertains to a new gambling glove for protecting the hand of a gambler, particularly when playing a slot machine.

2. Description of the Prior Art

The use of gloves is known in the prior art. More specifically, gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art gloves include U.S. Pat. No. 5,140,709; U.S. Pat. No. 2,040,137; U.S. Pat. No. 5,625,900; U.S. Pat. No. 5,659,899; U.S. Pat. No. 4,751,749; and U.S. Pat. No. Des. 97,885.

While these devices fulfill their respective, particular objectives and requirements, the aforementioned patents do not disclose a new gambling glove. The inventive device includes lightweight material for enclosing the hand and a plurality of leather reinforcement patches positioned particularly to prevent wear in areas particularly contacted while using a slot type gambling machine.

In these respects, the gambling glove according to the present invention substantially departs from the conventional concepts and designs of the prior art, and in so doing provides an apparatus primarily developed for the purpose of protecting the hand of a gambler, particularly when playing a slot machine.

SUMMARY OF THE INVENTION

In view of the foregoing disadvantages inherent in the known types of gloves now present in the prior art, the present invention provides a new gambling glove construction wherein the same can be utilized for protecting the hand of a gambler, particularly when playing a slot machine.

The general purpose of the present invention, which will be described subsequently in greater detail, is to provide a new gambling glove apparatus and method which has many of the advantages of the gloves mentioned heretofore and many novel features that result in a new gambling glove which is not anticipated, rendered obvious, suggested, or even implied by any of the prior art gloves, either alone or in any combination thereof.

To attain this, the present invention generally comprises lightweight material for enclosing the hand and a plurality of leather reinforcement patches positioned particularly to prevent wear in areas particularly contacted while using a slot type gambling machine.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gambling glove apparatus and method which has many of the advantages of the gloves mentioned heretofore and many novel features that result in a new gambling glove which is not anticipated, rendered obvious, suggested, or even implied by any of the prior art gloves, either alone or in any combination thereof.

It is another object of the present invention to provide a new gambling glove which may be easily and efficiently manufactured and marketed.

It is a further object of the present invention to provide a new gambling glove which is of a durable and reliable construction.

An even further object of the present invention is to provide a new gambling glove which is susceptible of a low cost of manufacture with regard to both materials and labor, and which accordingly is then susceptible of low prices of sale to the consuming public, thereby making such gambling glove economically available to the buying public.

Still yet another object of the present invention is to provide a new gambling glove which provides in the apparatuses and methods of the prior art some of the advantages thereof, while simultaneously overcoming some of the disadvantages normally associated therewith.

Still another object of the present invention is to provide a new gambling glove for protecting the hand of a gambler, particularly when playing a slot machine.

Yet another object of the present invention is to provide a new gambling glove which includes lightweight material for enclosing the hand and a plurality of leather reinforcement patches positioned particularly to prevent wear in areas particularly contacted while using a slot type gambling machine.

Still yet another object of the present invention is to provide a new gambling glove that protects the fingertips when handling coins dispensed from a slot type gambling machine.

Even still another object of the present invention is to provide a new gambling glove that provides reinforcement for areas of the hand primarily contacted when gambling using a slot type gambling machine.

Yet still another object of the present invention is to provide a lightweight glove that is easy to put on and take off.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
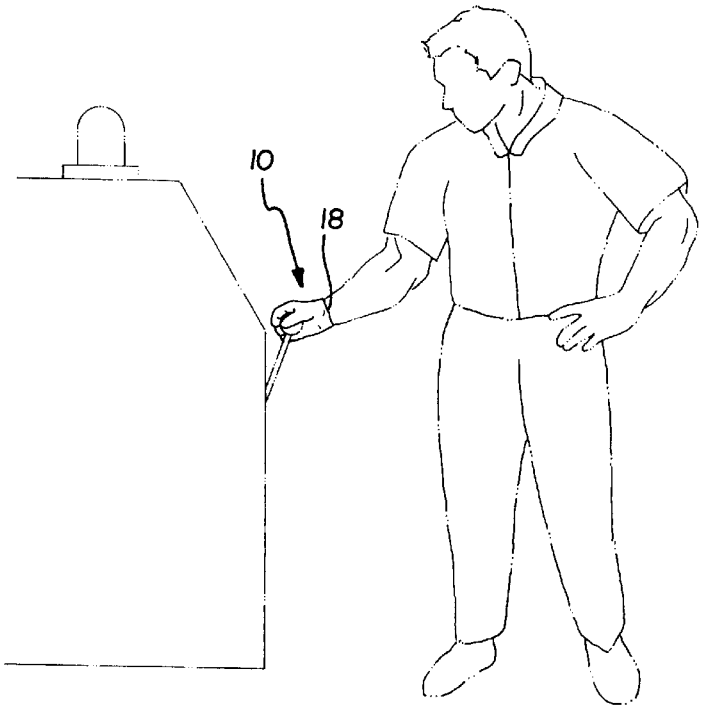
FIG. 1 is a perspective view of a gambling glove according to the present invention.
Figure 2:
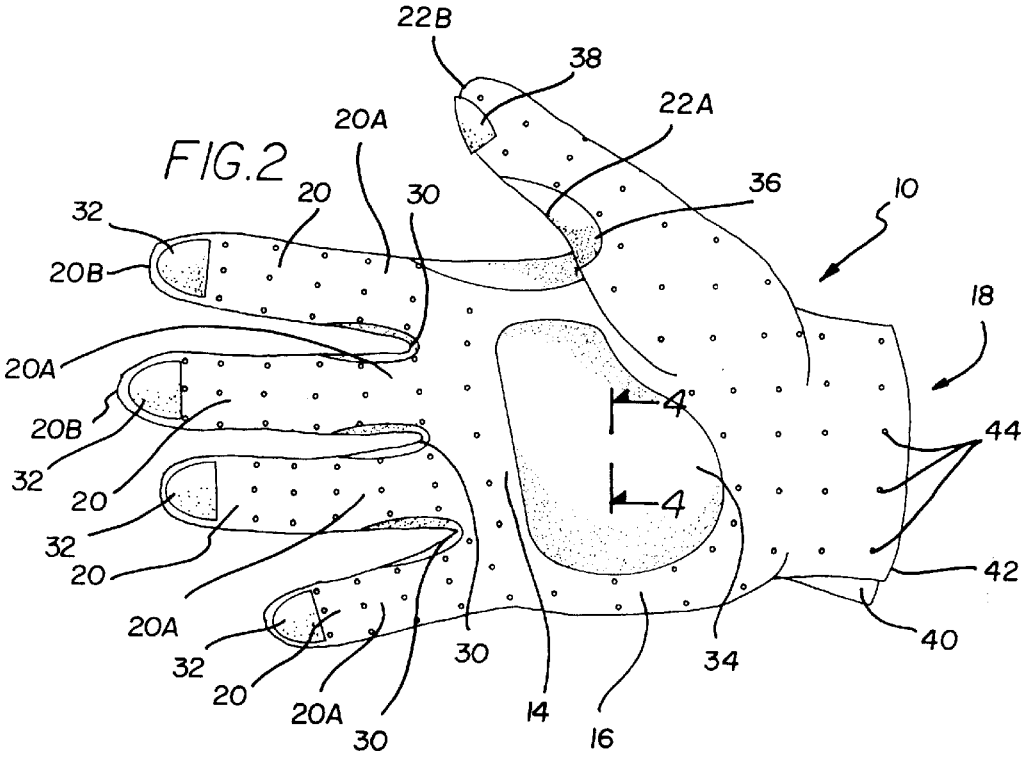
FIG. 2 is a front view of the present invention.
Figure 3:
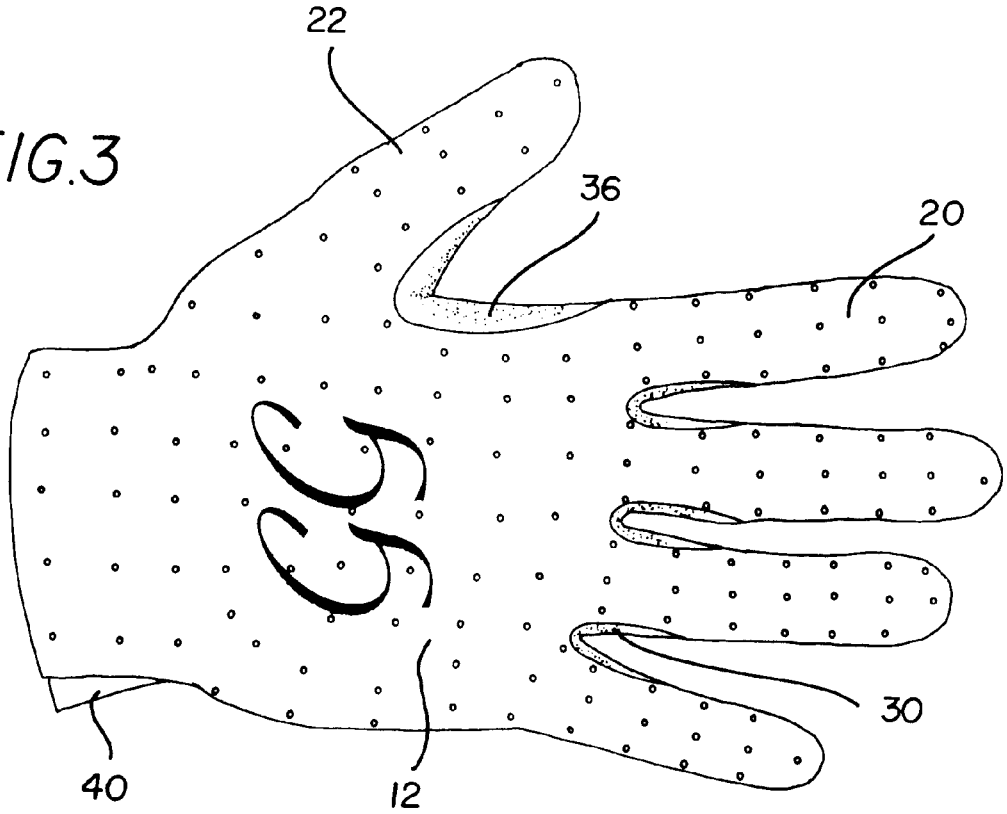
FIG. 3 is a back view of the present invention.
Figure 4:
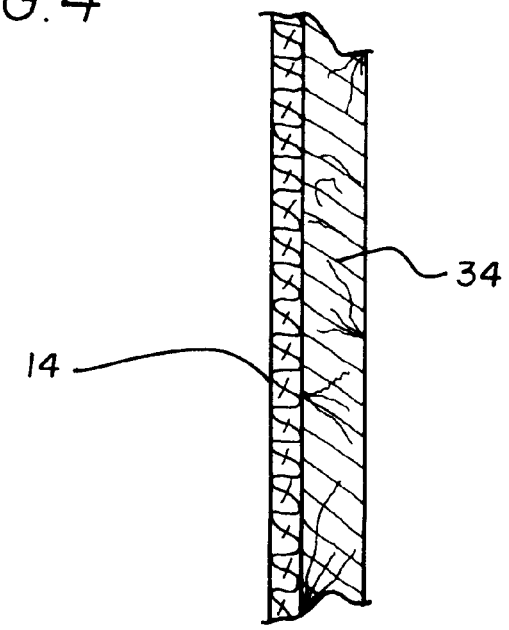
FIG. 4 is a partial cross-sectional view of glove taken along line 4—4 of FIG. 2.

With reference now to the drawings, and in particular to FIGS. 1 through 4 thereof, a new gambling glove embodying the principles and concepts of the present invention and generally designated by the reference numeral 10 will be described.

As best illustrated in FIGS. 1 through 4, the gambling glove 10 comprises a back portion 12 for covering the backside of a human hand and a front portion 14 for covering the palm of a human hand.

The front portion 14 is coupled to the back portion 12 to form a body portion 16 having an opening 18. The opening 18 is designed for insertion of a human hand therethrough.

A plurality of finger portions 20 are extended from the body portion 16 opposite the opening 18 for snugly surrounding the fingers of a human hand. A thumb portion 22 is extended from the body portion 16 for snugly surrounding the thumb of a human hand.

Inter-digital reinforcement members 30 are positioned between adjacent pairs of the plurality of finger portions 20 at a base end 20A of each of the adjacent pairs of finger portions 20. Fingertip reinforcement members 32 positioned on a palm side of a distal end 20A of each finger portion 20 for preventing wear of the distal end 20A of the finger portions 20 from handling coins dispensed by a slot type gambling machine.

A palm reinforcement member 34 is positioned on the front portion 14 of the body portion 16. The palm reinforcement member 34 is designed for preventing wear of a palm portion 17 of the front portion 14 from handling an arm of a slot type gambling machine.

A thumb reinforcement member 36 is extended along an interior side of the thumb portion 22A and extends continuously towards a base 20A of an adjacent one of the finger portions 20. A thumbtip reinforcement member 38 is positioned at a distal end 22B of the thumb portion 22.

The body portion 16 also includes a slit 40 in a perimeter edge 42 of the opening 18 for facilitating insertion of a human hand through the opening 18. The slit 40 is positioned opposite the thumb portion 22.

Most preferably, the front and back portions, 14 and 12 respectively, include a plurality of venting apertures 44 for permitting air to flow into and out of the glove 10.

The inter-digital reinforcement members 30, the fingertip reinforcement members 32, the palm reinforcement member 34, the thumb reinforcement member 36, and the thumbtip reinforcement member 38 are preferably made of leather.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove for use while utilizing a slot type gambling machine, the glove comprising:

a body portion having an opening and a plurality of finger portions extending from the body portion, the finger portions being positioned opposite the opening, the body portion and finger portions being constructed of a first material, the body portion and finger portions further being configured to generally conform to the shape of a human hand;

plurality of reinforcement portions coupled to discrete areas of the body portion and finger portions; and wherein the plurality of reinforcement portions further includes inter-digital reinforcement members being positioned between adjacent pairs of the finger portions; and a plurality of fingertip reinforcement members, each fingertip reinforcement member being positioned on a palm side of a distal end of an associated one of said finger portions, each fingertip reinforcement member having a length extending from the distal end of the associated finger portion along a longitudinal axis of said associated finger portion to an interior edge of said fingertip reinforcement member, said length of each said fingertip reinforcement portion being less than about one fourth a length of said associated finger portion such that said interior edge of said fingertip reinforcement member is adapted to be positioned between a fingertip and a distal knuckle of the user when the glove is worn by the user for facilitating free movement of the distal knuckle of the user during use, said fingertip reinforcement members being for preventing wear of the distal end of the finger portions from handling coins dispensed by a slot type gambling machine.

2. The glove of claim 1 wherein the body portion includes a slit in a perimeter edge of the opening for facilitating insertion of a human hand through the opening.

3. The glove of claim 2 wherein the slit is positioned opposite a thumb portion extending from the body portion.

4. A glove for use while utilizing a slot type gambling machine, the glove comprising:

a body portion having an opening and a plurality of finger portions extending from the body portion, the finger portions being positioned opposite the opening, the body portion and finger portions being constructed of a first material, the body portion and finger portions further being configured to generally conform to the shape of a human hand;

plurality of reinforcement portions coupled to discrete areas of the body portion and finger portions;

a front portion and a back portion coupled together along an outer edge to form a palm portion, a thumb portion and the plurality of finger portions; and wherein the reinforcement portions further include inter-digital reinforcement members positioned between adjacent pairs of the plurality of finger portions; and a plurality of fingertip reinforcement members, each fingertip reinforcement member being positioned on a palm side of a distal end of an associated one of said finger portions, each fingertip reinforcement member having a length extending from the distal end of the associated finger portion along a longitudinal axis of said associated finger portion to an interior edge of said fingertip reinforcement member, said length of each said fingertip reinforcement portion being less than about one fourth a length of said associated finger portion such that said interior edge of said fingertip reinforcement member is adapted to be positioned between a fingertip and a distal knuckle of the user when the glove is worn by the user for facilitating free movement of the distal knuckle of the user during use, said fingertip reinforcement members being for preventing wear of the distal end of the finger portions from handling coins dispensed by a slot type gambling machine.

5. The glove of claim 4 wherein the reinforcement portions further comprise:

a palm reinforcement member positioned on the front portion of the body portion adapted for preventing wear of the palm portion from handling an arm of a slot type gambling machine; and a thumb reinforcement member extending along an interior side of the thumb portion and extending continuously towards a base of an adjacent one of the finger portions.

6. The glove of claim 5 wherein the body portion includes a slit in a perimeter edge of the opening for facilitating insertion of a human hand through the opening.

7. The glove of claim 6 wherein the slit is positioned opposite a thumb portion extending from the body portion.

8. A glove for use while utilizing a slot type gambling machine, the glove comprising:

a back portion for covering the backside of a human hand;

a front portion for covering the palm of a human hand, the front portion being coupled to the back portion to form a body portion having an opening, the opening being for insertion of a human hand therethrough;

a plurality of finger portions extending from the body portion opposite the opening for snugly surrounding the fingers of a human hand;

a thumb portion extending from the body portion for snugly surrounding the thumb of a human hand;

inter-digital reinforcement members positioned between adjacent pairs of the plurality of finger portions at a base end of each of the adjacent pairs of finger portions;

a plurality of fingertip reinforcement members, each fingertip reinforcement member being positioned on a palm side of a distal end of an associated one of said finger portions, each fingertip reinforcement member having a length extending from the distal end of the associated finger portion along a longitudinal axis of said associated finger portion to an interior edge of said fingertip reinforcement member, said length of each said fingertip reinforcement portion being less than about one fourth a length of said associated finger portion such that said interior edge of said fingertip reinforcement member is adapted to be positioned between a fingertip and a distal knuckle of the user when the glove is worn by the user for facilitating free movement of the distal knuckle of the user during use, said fingertip reinforcement members being for preventing wear of the distal end of the finger portions from handling coins dispensed by a slot type gambling machine;

a palm reinforcement member positioned on the front portion of the body portion, the palm reinforcement member being adapted for preventing wear of a palm portion of the front portion from handling an arm of a slot type gambling machine; and a thumb reinforcement member extending along an interior side of the thumb portion and extending continuously towards a base of an adjacent one of the finger portions.

9. The glove of claim 8 wherein the body portion includes a slit in a perimeter edge of the opening for facilitating insertion of a human hand through the opening.

10. The glove of claim 9 wherein the slit is positioned opposite a thumb portion extending from the body portion.

11. The glove of claim 8 wherein the front and back portions include a plurality of venting apertures for permitting air to flow therethrough.

12. The glove of claim 8, wherein the inter-digital reinforcement members, the fingertip reinforcement members, the palm reinforcement member, and the thumb reinforcement member are leather.

13. A glove for use while utilizing a slot type gambling machine, the glove comprising:

a back portion for covering the backside of a human hand;

a front portion for covering the palm of a human hand, the front portion being coupled to the back portion to form a body portion having an opening, the opening being for insertion of a human hand therethrough;

a plurality of finger portions extending from the body portion opposite the opening for snugly surrounding the fingers of a human hand;

a thumb portion extending from the body portion for snugly surrounding the thumb of a human hand;

inter-digital reinforcement members positioned between adjacent pairs of the plurality of finger portions at a base end of each of the adjacent pairs of finger portions;

a plurality of fingertip reinforcement members, each fingertip reinforcement member being positioned on a palm side of a distal end of an associated one of said finger portions, each fingertip reinforcement member having a length extending from the distal end of the associated finger portion along a longitudinal axis of said associated finger portion to an interior edge of said fingertip reinforcement member, said length of each said fingertip reinforcement portion being less than about one fourth a length of said associated finger portion such that said interior edge of said fingertip reinforcement member is adapted to be positioned between a fingertip and a distal knuckle of the user when the glove is worn by the user for facilitating free movement of the distal knuckle of the user during use, said fingertip reinforcement members being for preventing wear of the distal end of the finger portions from handling coins dispensed by a slot type gambling machine;

a palm reinforcement member positioned on the front portion of the body portion, the palm reinforcement member being adapted for preventing wear of a palm portion of the front portion from handling an arm of a slot type gambling machine;

a thumb reinforcement member extending along an interior side of the thumb portion and extending continuously towards a base of an adjacent one of the finger portions;

a thumbtip reinforcement member being positioned on a palm side of a distal end of the thumb portion for preventing wear of the distal end of the thumb portion from handling coins dispensed by a slot type gambling machine;

wherein the body portion includes a slit in a perimeter edge of the opening for facilitating insertion of a human hand through the opening;

wherein the slit is positioned opposite a thumb portion extending from the body portion;

wherein the front and back portions include a plurality of venting apertures for permitting air to flow therethrough; and wherein the inter-digital reinforcement members, the fingertip reinforcement members, the palm reinforcement member, the thumb reinforcement member, and the thumbtip reinforcement member are leather.

* * * * *